US009714486B2

(12) United States Patent
Van Belkom

(10) Patent No.: US 9,714,486 B2
(45) Date of Patent: Jul. 25, 2017

(54) RAILROAD TIE AND RAILROAD COMPRISING SUCH A RAILROAD TIE

(71) Applicant: LANKHORST ENGINEERED PRODUCTS B.V., Sneek (NL)

(72) Inventor: Arnoldus Van Belkom, Spannum (NL)

(73) Assignee: LANKHORST ENGINEERED PRODUCTS B.V., Sneek (NL)

( * ) Notice: Subject to any disclaimer, the term of this patent is extended or adjusted under 35 U.S.C. 154(b) by 54 days.

(21) Appl. No.: 14/654,972

(22) PCT Filed: Nov. 14, 2013

(86) PCT No.: PCT/NL2013/050820

§ 371 (c)(1),
(2) Date: Jun. 23, 2015

(87) PCT Pub. No.: WO2014/104873

PCT Pub. Date: Jul. 3, 2014

(65) Prior Publication Data

US 2016/0194834 A1 Jul. 7, 2016

(30) Foreign Application Priority Data

Dec. 24, 2012 (NL) ..... 2010056

(51) Int. Cl.

| | |
|---|---|
| ***E01B 3/40*** | (2006.01) |
| ***E01B 3/44*** | (2006.01) |
| *E01B 3/32* | (2006.01) |

(52) U.S. Cl.
CPC . *E01B 3/44* (2013.01); *E01B 3/32* (2013.01)

(58) Field of Classification Search
CPC ..... E01B 3/32; E01B 3/34; E01B 3/36; E01B 3/44; E01B 3/46
See application file for complete search history.

(56) References Cited

U.S. PATENT DOCUMENTS

| | | | | |
|---|---|---|---|---|
| 7,204,430 | B2 | 4/2007 | Barmakian et al. | |
| 8,366,015 | B2 * | 2/2013 | Van Belkom | E01B 3/44 238/83 |

(Continued)

FOREIGN PATENT DOCUMENTS

| | | | |
|---|---|---|---|
| WO | 2005100691 | A1 | 10/2005 |
| WO | 2006088857 | A1 | 8/2006 |
| WO | 2008048095 | A1 | 4/2008 |

*Primary Examiner* — Jason C Smith
(74) *Attorney, Agent, or Firm* — Pearne & Gordon LLP

(57) ABSTRACT

A railroad tie (1) is manufactured from at least plastic (2), wherein an elongated reinforcing structure (3) is embedded in the plastic. The reinforcing structure in the longitudinal tie direction (L) is extending at least from and including at least a part of one (15) of the two rail supporting longitudinal tie segments up to and including at least a part of the other (16) of the two rail supporting longitudinal tie segments of the railroad tie. In the two rail supporting longitudinal tie segments the railroad tie has a lower lateral stiffness than in an intermediate longitudinal tie segment (17), lying in-between the two rail supporting longitudinal tie segments, which lower lateral stiffness is realized at least by change of shape of the elongated reinforcing structure in the longitudinal tie direction and/or by the range within which said reinforcing structure extends in the longitudinal tie direction.

7 Claims, 6 Drawing Sheets

(56) References Cited

U.S. PATENT DOCUMENTS

| | | | | |
|---|---|---|---|---|
| 2006/0180046 | A1* | 8/2006 | Barmakian | E01B 3/46<br>104/124 |
| 2007/0187522 | A1* | 8/2007 | Kirchmer | E01B 3/44<br>238/84 |
| 2009/0308824 | A1* | 12/2009 | Van Belkom | A47B 81/007<br>211/85.18 |
| 2010/0037795 | A1* | 2/2010 | Van Belkom | E01B 3/44<br>104/9 |
| 2016/0194834 | A1* | 7/2016 | Van Belkom | E01B 3/44<br>238/69 |

* cited by examiner

RAILROAD TIE AND RAILROAD COMPRISING SUCH A RAILROAD TIE

The invention relates to a railroad tie for use in a railroad, which railroad tie is manufactured from at least plastic, and wherein an elongated reinforcing structure is embedded in the plastic. The elongated reinforcing structure is extending with its longitudinal direction in the longitudinal direction of the railroad tie. The invention also relates to a railroad, which comprises at least one such a railroad tie.

A railroad tie, which is manufactured from plastic and which has such a reinforcing structure, is known from WO2006088857A1. This known railroad tie has a good flexural rigidity thanks to its large metal reinforcing structure having high height. However, it is disadvantageous that the large reinforcing structure of high height results into bad damping characteristics of the railroad tie, when railroad carriages riding over the railroad exert, via the rails, dynamic forces onto the railroad tie. These bad damping characteristics usually not only result into excessive noise production, but also unfavourably influence the underground of the railroad. If, for example, the underground is part of a railroad bridge, the railroad bridge in the long run may experience damage. And if the underground is a ballast bed, the ballast bed in the long run may experience damage, whereby the ballast needs replacement within a shorter time period and/or the railway needs re-stabilization and/or needs to be brought at its correct height again.

Another railroad tie, which is manufactured from plastic and which has such a reinforcing structure, is known from US2007187522A1. The purpose of the reinforcing structure of this railroad tie, known from US2007187522A1, is to give this railroad tie an acceptable stiffness/strength at minimized weight of the railroad tie, see paragraphs [0020]-[0022] of US2007187522A1. FIGS. 7-11 of US2007187522A1 show the railroad tie 20, which comprises a reinforcing structure in the form of the shown insert 40. In FIGS. 7-9 of US2007187522A1 it is seen that the insert 40 is situated in-between the two longitudinal tie segments 44, which are situated below the rails 42, that is in-between the two areas 32 where the rails 42 are attached to the railroad tie, also see paragraphs [0064] and [0066]. US2007187522A1 teaches to not situate the insert 40 under the rails 42, for the reason that the soft plastic of the two longitudinal tie segments 44 then permits that these segments 44 can handle the compressive forces exerted on them from the load of a train running directly above them, see paragraph [0064], last sentence. Although the railroad tie known from US2007187522A1 therefore has a better damping behaviour than the railroad tie known from WO2006088857A1, it is disadvantageous that the flexural rigidity and the durability of the railroad tie known from US2007187522A1 are worse than the flexural rigidity and the durability of the railroad tie known from WO2006088857A1.

Yet another railroad tie, which is manufactured from plastic and which has a reinforcing structure, is known from WO2008048095A1. For this railroad tie known from WO2008048095A1, the plastic is Low Density Polyethylene (LDPE), and the reinforcing structure consists of a number of separate steel bars, which are extending parallel and distant relative to one another. Steel bars of the reinforcing structure lying above one another are not connected to one another by the reinforcing structure itself, but by the plastic. This railroad tie known from WO2008048095A1 generally has very good damping properties and its flexural rigidity generally is acceptable for practice. These very good damping properties are explained in that, unlike the railroad tie known from WO2006088857A1, the steel bars of the reinforcing structure which are lying above one another are not connected to one another by the reinforcing structure itself, but by the plastic. Because of this, the damping characteristics are being determined to a more important extent by the plastic, which has a considerably lower lateral stiffness than the reinforcing structure. Said acceptable flexural rigidity is explained in that the bars lying above one another can excellently handle the tensile and compressive stresses, occurring when the railroad tie bends, while the plastic can generally handle the shear stresses, occurring between the bars lying above one another, rather well when the railroad tie bends.

For some railroad tie designs it is, however, desirable to further improve the flexural rigidity obtainable with the technique known from WO2008048095A1. This may for example be the case because in some uses of the railroad ties the desired flexural rigidity is extra high. However, this may for example also be the case because with some designs of railroad ties, for various reasons, various recessed shapes are applied relative to a railroad tie design being designed as a fully straight beam. As an illustration, reference is made to FIGS. 1-3 of WO2008048095A1, in which such a straight beam is shown, as well as to FIGS. 4A-8B of WO2008048095A1, in which some such recessed shapes are shown. In case of some, far-going recessed shapes, it may be that because of the strongly reduced amount of plastic in the railroad tie, the plastic can handle the shear stresses, occurring between the bars lying above one another, less well when the railroad tie bends.

It is an object of the invention to provide a durable railroad tie, which railroad tie combines very good damping properties with a very good flexural rigidity.

For that purpose, the invention provides a railroad tie for use in a railroad, which railroad tie is manufactured from at least plastic, and wherein an elongated reinforcing structure is embedded in the plastic, and which railroad tie has a reference condition, being an installed operation condition of the railroad tie, in which reference condition the longitudinal tie direction of the railroad tie and a rail track direction of the railroad, which rail track direction is perpendicular to the longitudinal tie direction, are each extending horizontally, wherein, as seen in said reference condition:

- the railroad tie has an upper side, which has two respective rail attachment areas, being mutually spaced apart in the longitudinal tie direction, and onto which two respective rails, extending mutually parallel in the rail track direction, are attachable by means of attachment means;
- the railroad tie has two respective rail supporting longitudinal tie segments, which are situated vertically below the two respective rail attachment areas; and
- the elongated reinforcing structure in the longitudinal tie direction is extending at least from and including at least a part of one of the two rail supporting longitudinal tie segments up to and including at least a part of the other of the two rail supporting longitudinal tie segments; and wherein in the two rail supporting longitudinal tie segments the railroad tie has a lower lateral stiffness than in an intermediate longitudinal tie segment, lying in-between the two rail supporting longitudinal tie segments, which lower lateral stiffness is realized at least by change of shape of said reinforcing structure in the longitudinal tie direction and/or by the range within which said reinforcing structure extends in the longitudinal tie direction.

By its nature to serve as reinforcement of the plastic, the material of the reinforcing structure has a higher lateral stiffness than the plastic. Since, according to the invention, the elongated reinforcing structure is extending from and including said one rail supporting longitudinal tie segment, and via the intermediate longitudinal tie segment, up to and including the other rail supporting longitudinal tie segment, this reinforcing structure provides a good resistance against bending of the railroad tie under influence of forces exerted from both rails onto the railroad tie. As a consequence of the locally lower lateral stiffness in the two rail supporting longitudinal tie segments, the dynamic forces exerted from both rails onto the railroad tie are being damped at the most effective locations.

Thanks to the variable damping behaviour, thus being incorporated in the railroad tie itself, the damping measures commonly applied in railroads, such as the application of separate damping material between rails and railroad ties, can be restricted or omitted. The invention thus allows for significant savings regarding installation and maintenance of railroads. Also, thanks to the plastic and to the fact that the reinforcing structure is embedded in the plastic, the railroad tie according to the invention additionally is durable.

All these aspects taken together, the advantages therefore are enormous, also because railroad ties are applied in railroads in very large numbers.

Therefore, the invention is based on the very effective use to the full of reinforcing structures applied in plastic railroad ties for obtaining railroad ties, which in use exhibit an excellent combination of flexural rigidity and damping behaviour. Such a use to the full is extraordinary and the results thereof are surprising, since the requirements of flexural rigidity and damping behaviour of a railroad tie in principle are mutually contradictory.

In a preferable embodiment of the invention, said reinforcing structure in at least one cross-section, as seen perpendicular to the longitudinal tie direction, of the two rail supporting longitudinal tie segments occupies less surface area than in at least one cross-section, as seen perpendicular to the longitudinal tie direction, of said intermediate longitudinal tie segment. Because of this, the plastic, which has a lower lateral stiffness than the reinforcing structure, determines the lateral stiffness of the railroad tie in the rail supporting longitudinal tie segments to a more important extent than in the intermediate longitudinal tie segment.

In another a preferable embodiment of the invention, the railroad tie is free from said reinforcing structure in at least one cross-section, as seen perpendicular to the longitudinal tie direction, of the two rail supporting longitudinal tie segments. Because of this, the two rail supporting longitudinal tie segments have longitudinal sub-segments, in which per unit of length in the longitudinal tie direction there is no presence at all of material of the reinforcing structure. Hence, in the last mentioned longitudinal sub-segments the lateral stiffness of the railroad tie is fully determined by the low lateral stiffness of the plastic.

In a further preferable embodiment of the invention, the railroad tie in at least one cross-section, as seen perpendicular to the longitudinal tie direction, of the two rail supporting longitudinal tie segments has a larger shortest distance between the upper side of the railroad tie and the uppermost part, as seen in said reference condition of the railroad tie, of said reinforcing structure, than in at least one cross-section, as seen perpendicular to the longitudinal tie direction, of said intermediate longitudinal tie segment. Hence, the two rail supporting longitudinal tie segments have longitudinal sub-segments, in which there exists a larger quantity of plastic damping material between the upper side of the railroad tie and the uppermost part of the reinforcing structure.

In a further preferable embodiment of the invention, said lower lateral stiffness of the railroad tie is realized in that in at least one cross-section, as seen perpendicular to the longitudinal tie direction, of the two rail supporting longitudinal tie segments the elongated reinforcing structure, when viewed apart, has a lower lateral stiffness than in at least one cross-section, as seen perpendicular to the longitudinal tie direction, of said intermediate longitudinal tie segment. This may for example be realized in that the reinforcing structure is formed by, for example, two reinforcement bars, lying alongside of one another, which, locally at one or more locations in the longitudinal tie direction, are connected to one another by means of transverse connections of the reinforcing structure. At the location of such a transverse connection, it is more difficult to push the two reinforcement bars transversely towards one another than at locations where such transverse connections are absent.

In a further preferable embodiment of the invention, as seen in said reference condition, the elongated reinforcing structure comprises at least one assembly, which assembly comprises at least two reinforcement bars, which are extending in the longitudinal tie direction, and which are directly and/or via material of the reinforcing structure connected to one another, and of which a first reinforcement bar along at least a part of the longitudinal tie direction is lying higher in the railroad tie than a second reinforcement bar thereof. Because of this, the desired beneficial combination of flexural rigidity and damping behaviour can be obtained with relatively little reinforcing material.

The invention is furthermore embodied in a railroad comprising at least one railroad tie according to any one of the abovementioned embodiments, as well as at least two respective rails, which are extending mutually parallel in the rail track direction, wherein the two rails are attached onto the two respective rail attachment areas.

In the following, the invention is further elucidated with reference to the schematic Figures in the attached drawing.

Figure 1:
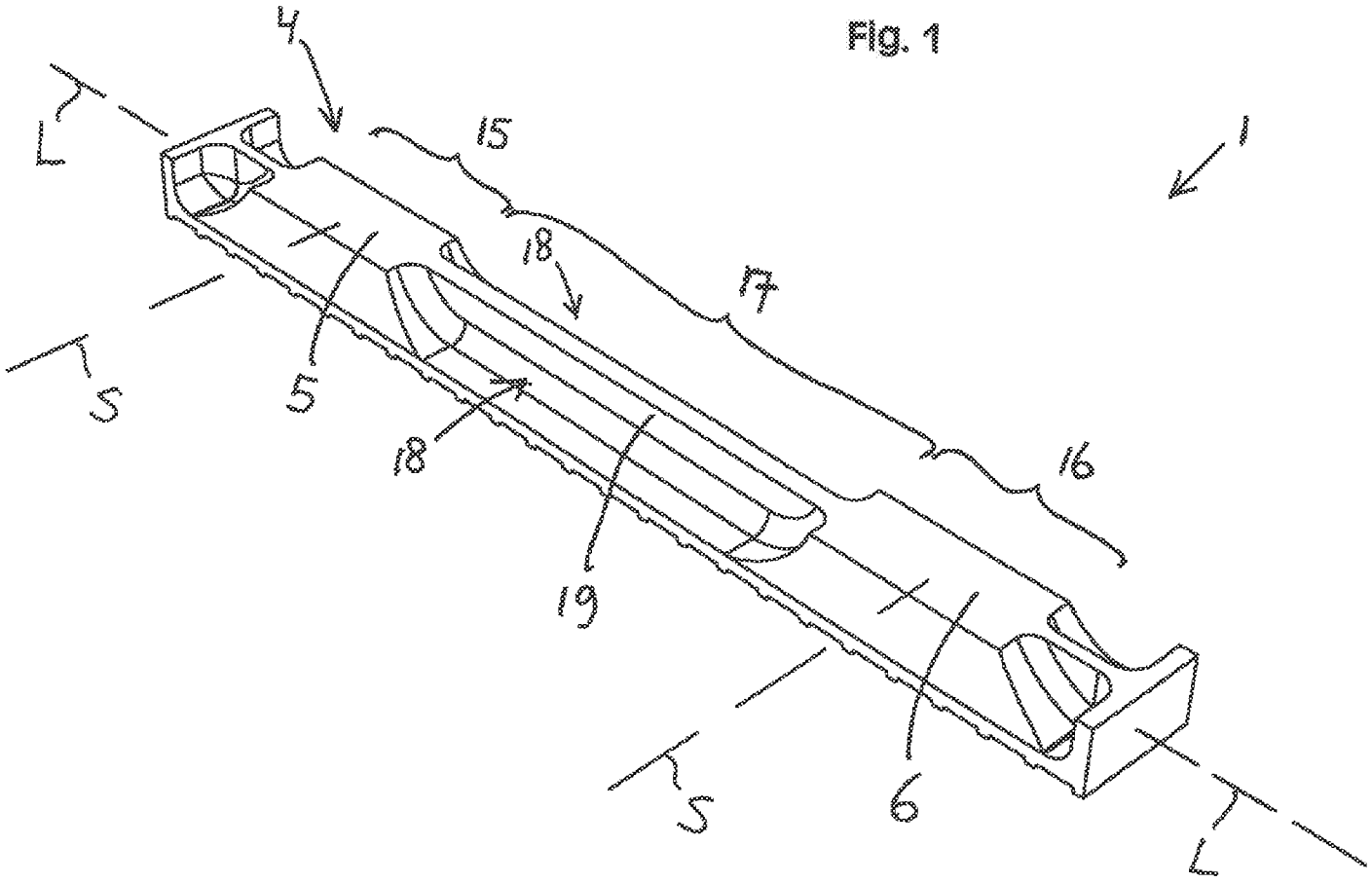
FIG. 1 shows, in a perspective view, an example of an embodiment of a railroad tie according to the invention.

For the railroad tie 1 shown in FIG. 1 the longitudinal tie direction is indicated with reference sign L. The corresponding rail track direction is indicated with reference sign S. In FIG. 1 the perspective view is, amongst others, onto the upper side 4 of the railroad tie. The two rail attachment areas of this upper side 4 are indicated with reference numerals 5 and 6. As can be seen in FIG. 2B, rails 7 and 8 can be attached to these rail attachment areas 5 and 6 by means of attachment means 27 and 28 (such as for example the well-known tie plates).

The rail supporting longitudinal tie segments of the railroad tie 1, which segments are situated vertically below the two rail attachment areas 5 and 6, are indicated in FIGS. 1 and 2B with reference numerals 15 and 16. The intermediate longitudinal tie segment 17 of the railroad tie 1 is extending in-between the longitudinal segments 15 and 16.

It is remarked that, in the shown example, the railroad tie 1 is substantially symmetrically shaped, both relative to its vertical longitudinal mid-section (perpendicular to the rail track direction S), and relative to its vertical transverse mid-section (perpendicular to the longitudinal tie direction L). In FIG. 1 it is seen that in this example the railroad tie 1 has a number of recessed spaces, of which two are indicated with reference numeral 18. These recessed spaces 18 are situated in the intermediate longitudinal tie segment 17. In-between these two recessed spaces 18 the railroad tie has in its intermediate longitudinal tie segment 17 an upright ridge 19, which extends in the longitudinal tie direction L.

Figure 2A:
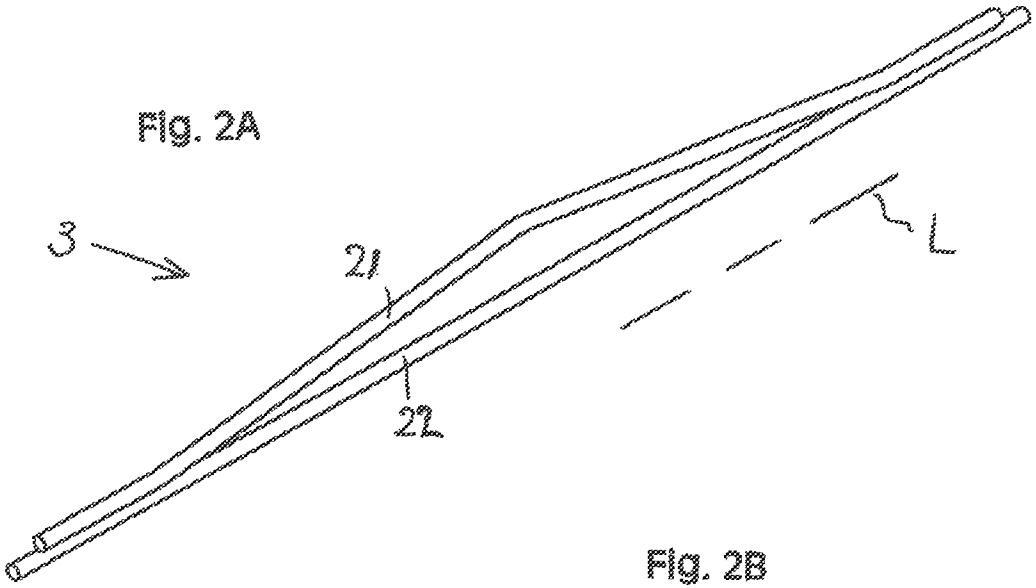
FIG. 2A shows, in a perspective view, an example of an embodiment of an elongated reinforcing structure for the railroad tie of FIG. 1.
Figure 2B:
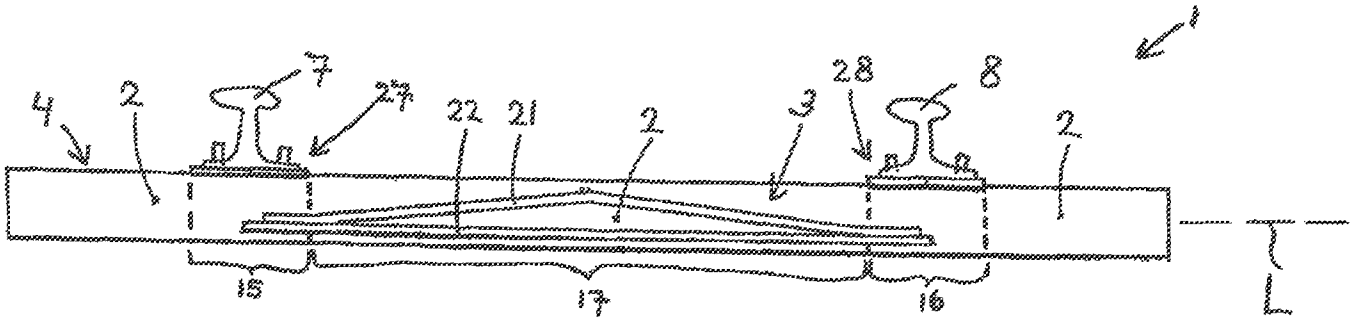
FIG. 2B shows the railroad tie of FIG. 1 in a vertical longitudinal mid-section of the railroad tie, wherein the railroad tie comprises the reinforcing structure of FIG. 2A.

The reinforcing structure 3, shown in FIGS. 2A and 2B, which is embedded in the plastic 2 of the railroad tie 1, is an assembly of two reinforcement bars 21 and 22, which are extending in the longitudinal tie direction L. The reinforcement bar 21 has a buckle in its middle and is connected, at end parts near its ends, with end parts near the ends of the reinforcement bar 22, which is straight. These connections may for example be welded connections. The reinforcement bar 21 is situated higher in the railroad tie than the reinforcement bar 22. For a large part of its length, the reinforcement bar 21 is lying in the upright ridge 19 of the railroad tie 1, where it is embedded in the plastic 2.

In FIG. 2B it is seen that the reinforcing structure 3 in the longitudinal tie direction L is at least extending from and including a part of the rail supporting longitudinal tie segment 15 up to and including a part of the rail supporting longitudinal tie segment 16. Further it is seen that the shape of the reinforcing structure 3 varies in the longitudinal tie direction L. In this respect it is for example seen that the distance between the reinforcement bars 21 and 22, as seen perpendicularly to the longitudinal tie direction L, in the middle of the length of the reinforcing structure 3 is larger than near the longitudinal ends of the reinforcing structure 3.

As a consequence of this shown configuration of the reinforcing structure 3 in the railroad tie 1, the railroad tie 1 has in the two rail supporting longitudinal tie segments 15 and 16 a lower lateral stiffness than in the intermediate longitudinal tie segment 17 of the railroad tie. After all, in the longitudinal segments 15 and 16 the lateral stiffness of the railroad tie 1 is determined to a much more important extent by the plastic 2, than in the intermediate longitudinal tie segment 17, while the plastic 2 has a lower lateral stiffness than the reinforcing structure 3.

The reinforcing structure 3 being embedded in this way in the plastic 2 provides a good resistance against bending of the railroad tie 1 under influence of the forces exerted onto the railroad tie, which forces are coming from both rails 7 and 8. As a consequence of the locally lower lateral stiffness in the two rail supporting longitudinal tie segments 15 and 16, the dynamical forces, coming from both rails, exerted onto the railroad tie are effectively damped.

In the example of FIG. 2B the lower lateral stiffness of the railroad tie 1 in its longitudinal segments 15 and 16 has been achieved in multiple ways.

In the first place, it can be derived particularly from FIG. 2B that the reinforcing structure 3 in some cross-sections (perpendicular to the longitudinal tie direction L) of the two longitudinal segments 15 and 16 occupies less surface area than in such cross-sections of the intermediate longitudinal tie segment 17. More precisely, this applies to those cross-sections of the two longitudinal segments 15 and 16, in which of the reinforcing structure 3 only the lower reinforcement bar 22 is seen, not the upper reinforcement bar 21. The two longitudinal segments 15 and 16 therefore have longitudinal sub-segments in which per unit of length in the longitudinal tie direction L less material of the reinforcing structure 3 is present than in the intermediate longitudinal tie segment 17.

In the second place, it can be derived particularly from FIG. 2B that the elongated reinforcing structure 3, as seen in the longitudinal tie direction L, ends within the longitudinal segments 15 and 16. In other words, the railroad tie 1 in some cross-sections (perpendicular to the longitudinal tie direction L) of the two longitudinal segments 15 and 16 is fully free from the reinforcing structure 3. The two longitudinal segments 15 and 16 therefore have longitudinal sub-segments in which per unit of length in the longitudinal tie direction L no material of the reinforcing structure 3 is present at all. In the last mentioned longitudinal sub-segments the lateral stiffness of the railroad tie 1 is therefore fully determined by the low lateral stiffness of the plastic 2. In this example, the lower lateral stiffness of the railroad tie 1 in the two longitudinal segments 15 and 16 is therefore in fact also realized by the range in which the reinforcing structure 3 extends in the longitudinal tie direction L. In this respect it is remarked that said lower lateral stiffness of the railroad tie 1 in the two longitudinal segments 15 and 16 in alternative embodiments can also be realized if in such alternative embodiments the reinforcing structure is only formed by the reinforcement bar 21, or only formed by the reinforcement bar 22.

In the third place it can be derived particularly from FIG. 2B that in the cross-sections (perpendicular to the longitudinal tie direction L) of the two longitudinal segments 15 and 16, in which space is occupied by the reinforcing structure 3, the shortest distance between the upper side 4 of the railroad tie 1 and the upper part of the reinforcing structure 3 is larger than in similar cross-sections of the intermediate longitudinal tie segment 17. The two longitudinal segments 15 and 16 therefore have longitudinal sub-segments in which a larger amount of plastic material is present between the upper side 4 of the railroad tie 1 and the upper part of the reinforcing structure 3.

Figure 3A:
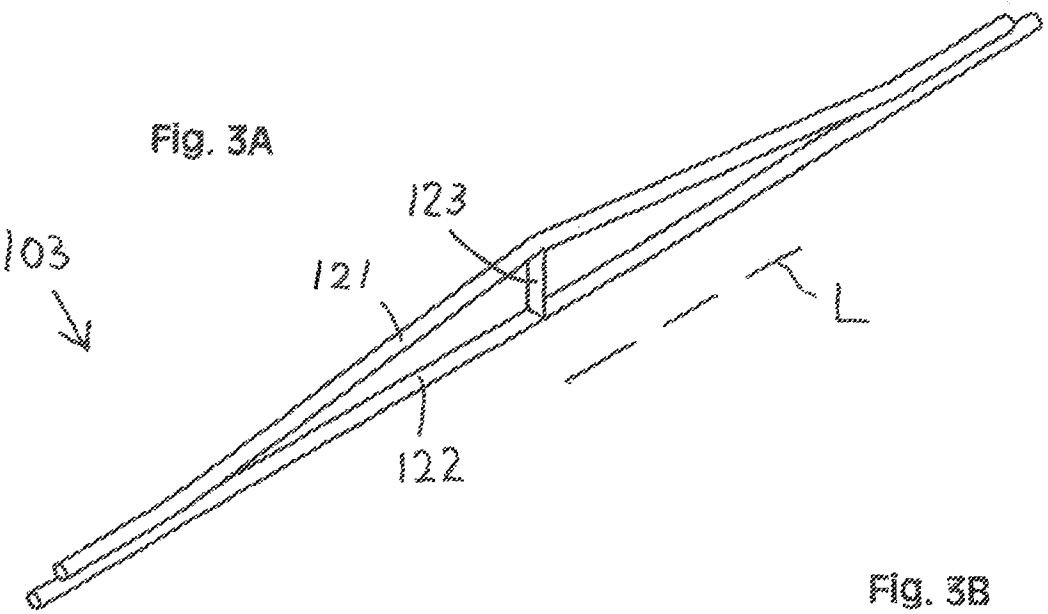
FIG. 3A shows, in a perspective view, an example of an alternative embodiment of an elongated reinforcing structure for the railroad tie of FIG. 1.
Figure 3B:
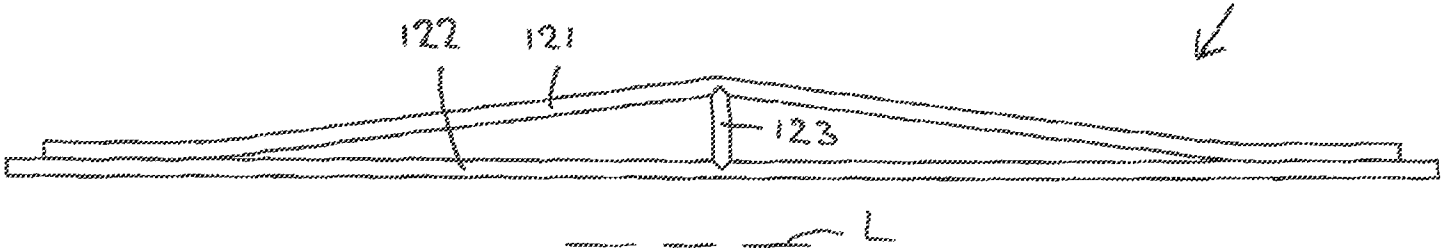
FIG. 3B shows the reinforcing structure of FIG. 3A in side view.

FIGS. 3A and 3B show a reinforcing structure 103 comprising reinforcement bars 121 and 122 which are identical to the reinforcement bars 21 and 22 of the reinforcing structure 3 of FIGS. 2A and 2B. The reinforcing structure 103 can be applied in the railroad tie 1 of FIG. 1 in a similar manner as the reinforcing structure 3. For that purpose, the longitudinal tie direction L has been indicated in FIGS. 3A and 3B. The only difference with the reinforcing structure 3 of FIGS. 2A and 2B is that the reinforcing structure 103 comprises an additional reinforcement bar 123, which connects the reinforcement bars 121 and 122 to one another, for example in that the additional reinforcement bar 123 with its ends is welded to the reinforcement bars 121 and 122. Due to the additional reinforcement bar 123 the reinforcing structure 103 is more stiff than the reinforcing structure 3, which can be desirable for some railroad ties. An advantage of the additional reinforcement bar 123 also is that during the manufacturing of the railroad tie, by means of for example injection moulding, the reinforcing structure 103 can deform less than the reinforcing structure 3 under influence of shrinkage of the plastic 2 during cooling of the plastic 2.

Figure 4A:
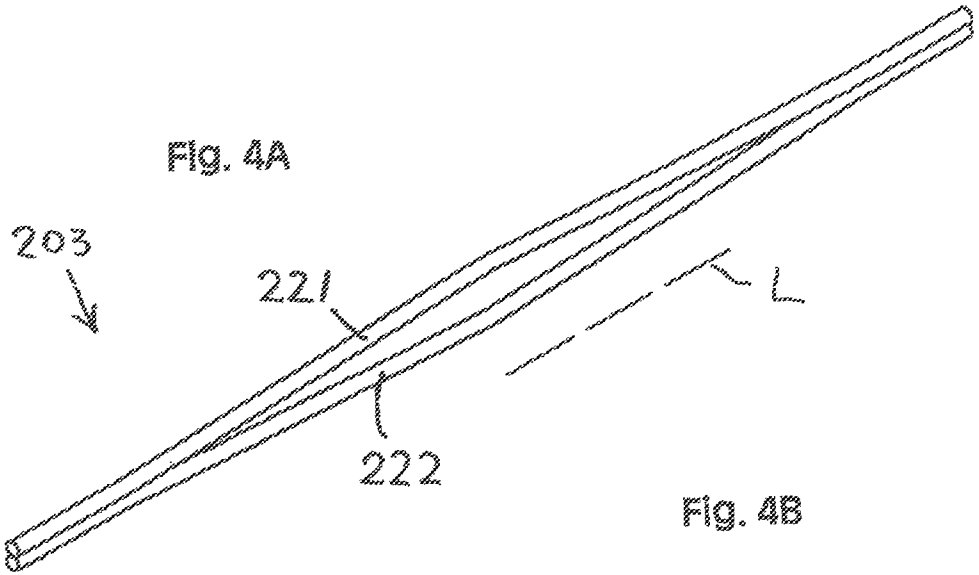
FIG. 4A shows, in a perspective view, an example of another alternative embodiment of an elongated reinforcing structure for the railroad tie of FIG. 1.
Figure 4B:
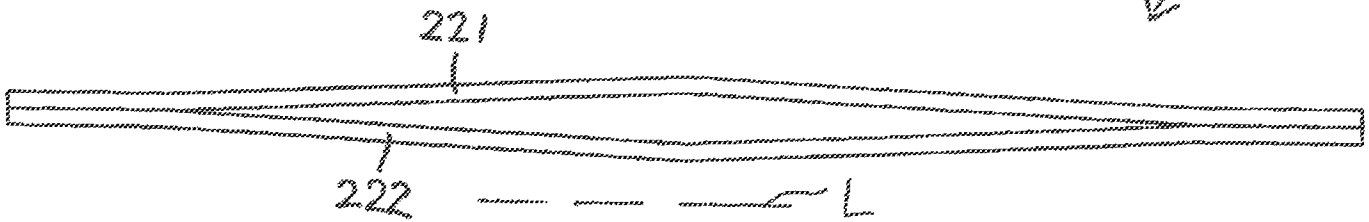
FIG. 4B shows the reinforcing structure of FIG. 4A in side view.

FIGS. 4A and 4B show a reinforcing structure 203 comprising reinforcement bars 221 and 222, each of which by itself being similar to the reinforcement bar 21 of the reinforcing structure 3 of FIGS. 2A and 2B. That is, each of the bars 221 and 222 has the same length as that of the bar 21 and is buckled in its middle, be it with a smaller buckle angle than that of the bar 21. The bars 221 and 222 are connected as mutual mirror images to one another via their longitudinal ends, for example by means of weld connections. The reinforcing structure 203 can be applied in the railroad tie 1 of FIG. 1 in a similar manner as the reinforcing structure 3. For that purpose, the longitudinal tie direction L has been indicated in FIGS. 4A and 4B. If applied in this manner in the railroad tie 1, and as compared with reinforcing structure 3 applied in the railroad tie 1, for the reinforcing structure 203 there therefore is in longitudinal subsegments of the two longitudinal segments 15 and 16 more plastic material present between the bottom side of the railroad tie and the lower part of the reinforcing structure. Such a situation can in some applications of railroad ties provide a further improved damping behaviour, for example when using railroad ties on a very hard underground (for example use on concrete, steel, etc., as opposed to use on/in a ballast bed being less hard). It is remarked that, if desired, also the reinforcing structure 203 can comprise an additional reinforcement bar, which connects the reinforcement bars 221 and 222 with one another, in a similar manner as in FIGS. 3A and 3B the additional reinforcement bar 123 connects the reinforcement bars 121 and 122 with one another.

Figure 5A:
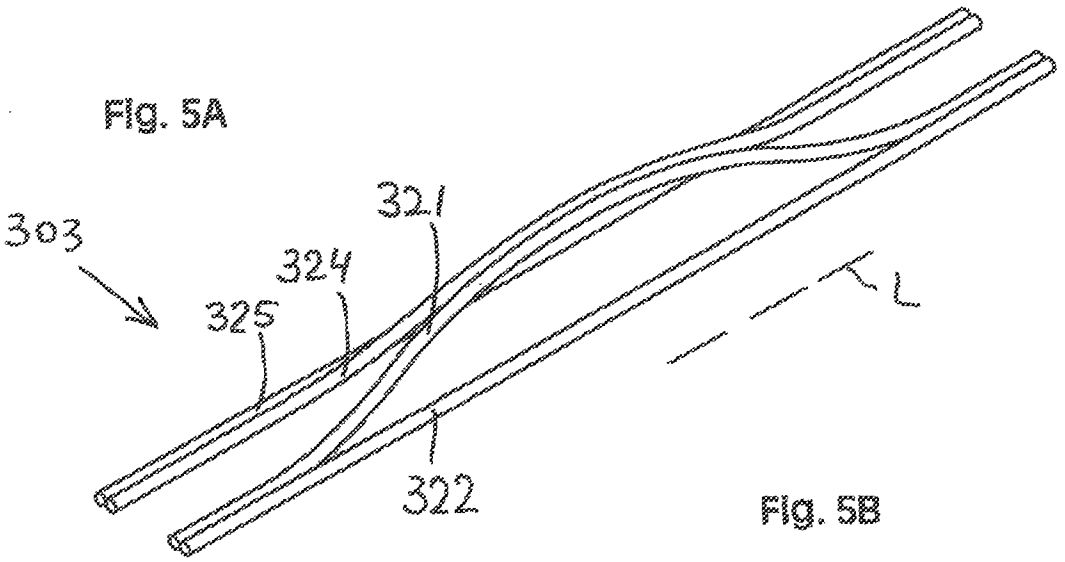
FIG. 5A shows, in a perspective view, an example of yet another alternative embodiment of an elongated reinforcing structure for a railroad tie according to the invention.
Figure 5B:
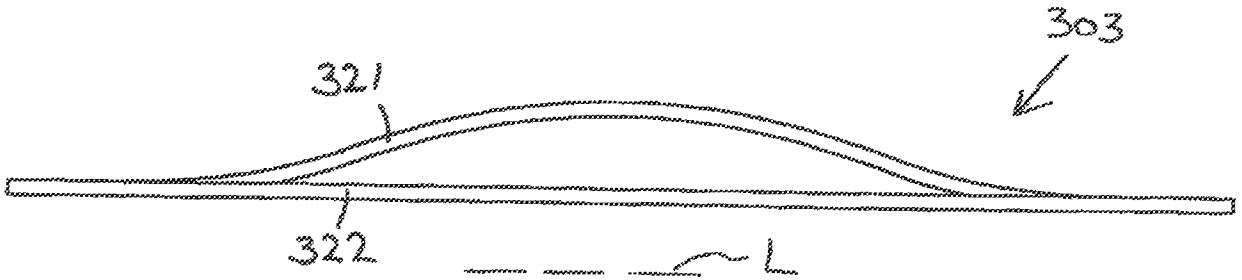
FIG. 5B shows the reinforcing structure of FIG. 5A in side view.

FIGS. 5A and 5B show a reinforcing structure 303 comprising reinforcement bars 321, 322, 324 and 325. The bars 321 and 322 are connected to one another via their longitudinal ends, for example by means of welding. Also the bars 324 and 325 are connected to one another via their longitudinal ends, for example by means of welding. Furthermore, the interconnected bars 321 and 322 are placed as mirror image relative to the interconnected bars 324 and 325. The reinforcing structure 303 can be applied in a similar manner as the reinforcing structure 3 in a railroad tie similar to the railroad tie 1 of FIG. 1. For that purpose, the longitudinal tie direction L has been indicated in FIGS. 5A and 5B. Optionally the interconnected bars 321 and 322 can be connected to the interconnected bars 324 and 325, for example by means of welding. The connections between the interconnected bars 321 and 322 and the interconnected bars 324 and 325 can for example be realized via upper parts of the bars 321 and 324 and/or via (not shown) additional connection parts of the reinforcing structure 303 between lower parts of the interconnected bars 321 and 322 and lower parts of the interconnected bars 324 and 325. It is, however, remarked that reducing or omitting such connections between the interconnected bars 321 and 322 and the interconnected bars 324 and 325 will improve the damping behaviour of the concerning railroad tie.

Figure 6A:
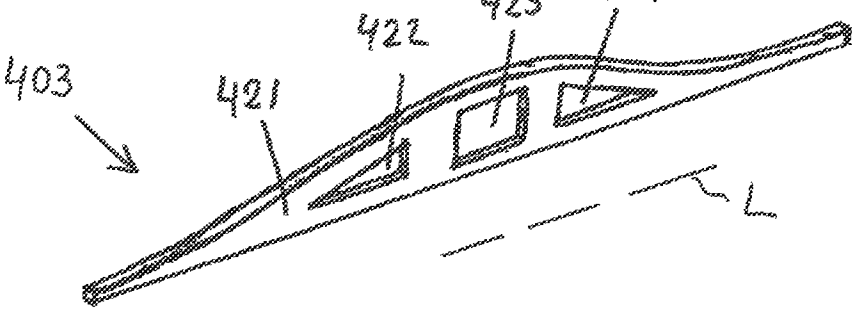
FIG. 6A shows, in a perspective view, an example of yet another alternative embodiment of an elongated reinforcing structure for the railroad tie of FIG. 1.
Figure 6B:
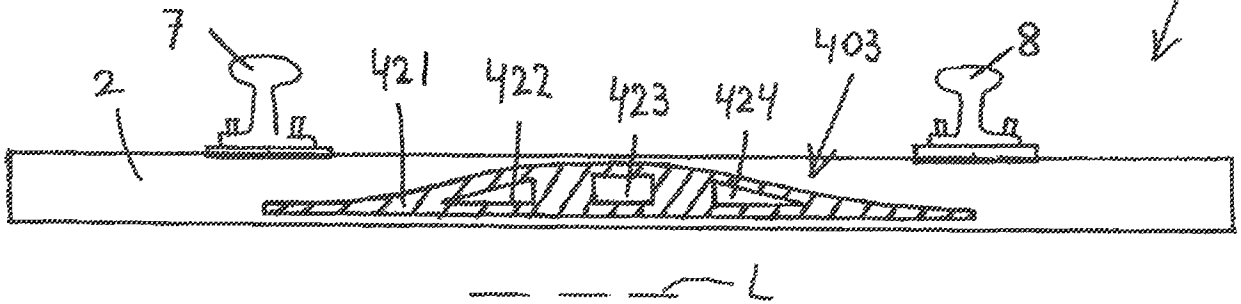
FIG. 6B shows the railroad tie of FIG. 1 in a vertical longitudinal mid-section of the railroad tie, wherein the railroad tie comprises the reinforcing structure of FIG. 6A.

FIGS. 6A and 6B show a reinforcing structure 403, which in FIG. 6B is applied in the railroad tie of FIG. 1. For that purpose, the longitudinal tie direction L has been indicated in FIGS. 6A and 6B. This railroad tie is, because of this alternative reinforcing structure 403, indicated here with another reference numeral, i.e. reference numeral 401. Furthermore, in FIG. 6B the plastic of the railroad tie 401 is indicated again by the reference numeral 2, and the rails are indicated again with the numbers 7 and 8. The reinforcing structure 403 provides similar advantages as explained above in relation to FIGS. 2A, 2B and 3A, 3B. A difference, however, is that the reinforcing structure 403 does not comprise interconnected reinforcement bars, but instead is formed by a plate-shaped reinforcement part 421, for example a steel plate. The plate-shaped reinforcement part 421 has a number of passageways in the rail track direction, in this case the passageways 422, 423 and 424. In these passageways the plastic 2 is present.

It is remarked that the abovementioned examples of embodiments of the invention do not limit the invention, and that various alternatives are possible within the scope of the appended claims.

For example, the railroad tie can be manufactured from various kinds of plastic, whether or not being recycled, and whether or not using various kinds of additives thereto. For example, the plastic can be a polyethylene.

Also, the reinforcing structures embedded in the plastic can be of various kinds of materials, such as various metals or metal alloys, steel, etcetera, but also various other kinds of construction materials, such as various construction plastics which have a higher lateral stiffness than the plastic in which the reinforcing structures are embedded. If the reinforcing structures comprise reinforcement bars, these bars can have various kinds of shapes. For example, the bars can have round, oval, polygonal, or many otherwise shaped cross-sections. Also, the reinforcing structures can have various non-flat surfaces for obtaining an improved force transmittal between the reinforcing structures and the plastic in which the reinforcing structures are embedded.

Furthermore, various variations are possible in the shapes and dimensions of the railroad tie. For example, the railroad tie can have various kinds of recessed spaces in all possible sides of the railroad tie, but the railroad tie can also be realized without any such recessed space.

Furthermore it is remarked that in the shown examples the reinforcing structures extend from the intermediate longitudinal tie segment to both sides thereof not farther in the longitudinal tie direction than within the rail supporting longitudinal tie segments. However, it is also possible that the reinforcing structures extend from the intermediate longitudinal tie segment to both sides thereof farther than within the rail supporting longitudinal tie segments, that is to say beyond the rail supporting longitudinal tie segments in the direction of the longitudinal ends of the railroad tie.

However, other variations and/or modifications are also possible. These and similar alternatives are deemed to fall within the scope of the invention as defined in the appended claims.

The invention claimed is:

1. A railroad tie for use in a railroad, which railroad tie is manufactured from at least plastic, and wherein an elongated reinforcing structure is embedded in the plastic, and which railroad tie has a reference condition, being an installed operation condition of the railroad tie, in which reference condition the longitudinal tie direction of the railroad tie and a rail track direction of the railroad, which rail track direction is perpendicular to the longitudinal tie direction, are each extending horizontally, wherein, as seen in said reference condition: the railroad tie has an upper side, which has two respective rail attachment areas, being mutually spaced apart in the longitudinal tie direction, and onto which two respective rails, extending mutually parallel in the rail track direction, are attachable by means of attachment means; the railroad tie has two respective rail supporting longitudinal tie segments, which are situated vertically below the two respective rail attachment areas; and the elongated reinforcing structure extends into at least a part of each of the two rail supporting longitudinal tie segments; characterized in that in the two rail supporting longitudinal tie segments the railroad tie has a lower lateral stiffness than in an intermediate longitudinal tie segment, lying in-between the two rail supporting longitudinal tie segments, which lower lateral stiffness is realized at least by change of shape of said reinforcing structure in the longitudinal tie direction and/or by the range within which said reinforcing structure extends in the longitudinal tie direction.

2. A railroad tie according to claim 1, wherein said reinforcing structure in at least one cross-section, as seen perpendicular to the longitudinal tie direction, of the two rail supporting longitudinal tie segments occupies less surface area than in at least one cross-section, as seen perpendicular to the longitudinal tie direction, of said intermediate longitudinal tie segment.

3. A railroad tie according to claim 1, wherein at least one cross-section, as seen perpendicular to the longitudinal tie direction, of the two rail supporting longitudinal tie segments is free from said reinforcing structure.

4. A railroad tie according to claim 1, wherein the railroad tie in at least one cross-section, as seen perpendicular to the longitudinal tie direction, of the two rail supporting longitudinal tie segments has a larger shortest distance between the upper side of the railroad tie and the uppermost part, as seen in said reference condition of the railroad tie, of said reinforcing structure, than in at least one cross-section, as seen perpendicular to the longitudinal tie direction, of said intermediate longitudinal tie segment.

5. A railroad tie according to claim 1, wherein said lower lateral stiffness of the railroad tie is realized in that in at least one cross-section, as seen perpendicular to the longitudinal tie direction, of the two rail supporting longitudinal tie segments the elongated reinforcing structure, when viewed apart, has a lower lateral stiffness than in at least one cross-section, as seen perpendicular to the longitudinal tie direction, of said intermediate longitudinal tie segment.

6. A railroad tie according to claim 1, wherein, as seen in said reference condition, the elongated reinforcing structure comprises at least one assembly, which assembly comprises at least two reinforcement bars, which are extending in the longitudinal tie direction, and which are directly and/or via material of the reinforcing structure connected to one another, and of which a first reinforcement bar along at least a part of the longitudinal tie direction is lying higher in the railroad tie than a second reinforcement bar thereof.

7. A railroad comprising at least one railroad tie according to claim 1, as well as at least two respective rails, which are extending mutually parallel in the rail track direction, wherein the two rails are attached onto the two respective rail attachment areas.

* * * * *